United States Patent [19]

Schramm et al.

[11] Patent Number: 4,462,892

[45] Date of Patent: Jul. 31, 1984

[54] CONTROL OF PROCESS AID USED IN HOT WATER PROCESS FOR EXTRACTION OF BITUMEN FROM TAR SAND

[75] Inventors: Laurier L. Schramm; Russell G. Smith, both of Edmonton, Canada

[73] Assignees: Petro-Canada Exploration Inc., Calgary; Her Majesty the Queen in right of Canada, as represented by the Minister of Energy and Natural Resources (Alberta Oil Sands Equity), Edmonton; PanCanadian Petroleum Limited, Calgary; Esso Resources Canada Limited, Calgary; Canada-Cities Service, Ltd., Calgary; Gulf Canada Limited, Calgary; Alberta Energy Company Ltd., Calgary; Hudson's Bay Oil and Gas Company Limited, Calgary; Petrofina Canada Inc., Calgary, all of Canada

[21] Appl. No.: 476,025

[22] Filed: Mar. 17, 1983

[51] Int. Cl.[3] ..... C10G 1/04

[52] U.S. Cl. ..... 208/11 LE

[58] Field of Search ..... 208/11 R, 11 LE, 8 R, 208/8 LE

[56] References Cited

U.S. PATENT DOCUMENTS 4,201,656 5/1980 Sanford ..... 208/11 LE

FOREIGN PATENT DOCUMENTS 639050 3/1962 Canada ..... 208/11 LE
1012083 6/1977 Canada ..... 208/11 LE
1094483 1/1981 Canada ..... 208/11 LE

*Primary Examiner*—Delbert E. Gantz
*Assistant Examiner*—A. Pal
*Attorney, Agent, or Firm*—Ernest Peter Johnson

[57] ABSTRACT

The hot water process is sensitive to the nature of the tar sand feed, which varies. An alkaline process aid, usually NaOH, is normally added to the conditioning step of the process and is needed to obtain good bitumen recovery from most tar sand feeds. The invention is based on the discovery that, for a particular extraction circuit used, there is a single value of free surfactant content in the aqueous phase of the process slurry which will yield maximum primary froth recovery regardless of the type of tar sand feed used. The process in accordance with the invention therefore comprises: (a) determining, for a single tar sand type and the extraction circuit used, the free surfactant content in the aqueous phase of the slurry, which will yield the maximum primary bitumen forth recovery; (b) monitoring the free surfactant content in the aqueous phase of the slurry during subsequent processing of various types of tar sand feed in said circuit; and (c) varying the process aid addition to the slurry as the nature of the tar sand feed varies, to maintain said free surfactant content substantially at the level which leads to maximum primary bitumen froth recovery.

2 Claims, 4 Drawing Figures

EXTRACTION

EXTRACTION

DIAGRAMATIC REPRESENTATION OF THE BATCH EXTRACTION UNIT

PRIMARY RECOVERIES OBTAINED FROM BATCH EXTRACTIONS OF ORES AS A FUNCTION OF THE FREE SURFACTANT LEVELS IN SECONDARY TAILINGS. THE CURVES CORRESPOND TO FRESH RICH ORE ● AND MARINE ORE WHICH WAS FRESH ▲, AGED 70 DAYS ■, AND AGED 90 DAYS ◆.

FOAM FRACTIONATION APPARATUS

CONTROL OF PROCESS AID USED IN HOT WATER PROCESS FOR EXTRACTION OF BITUMEN FROM TAR SAND

FIELD OF THE INVENTION

This invention relates to an improvement of the hot water process for extracting bitumen from tar sand. More particularly, it relates to process control, specifically control of process aid addition, whereby primary bitumen froth recovery may be maximized, in spite of the changing nature of the tar sand feed.

BACKGROUND OF THE INVENTION

Tar sand, also known as oil sand and bituminous sand, is now well recognized as a valuable source of hydrocarbons. There are presently two large plants producing synthetic crude from the tar stands of the Athabasca region of Alberta. In these operations, the tar sands are first mined and the bitumen is then extracted by a process called the hot water process. The extracted bitumen is subsequently upgraded by refinery-type processing to produce the synthetic crude.

The tar sand is a mixture of sand grains, connate water, fine minerals solids of the particle size of clay minerals, and bitumen. It is common believed that the connate water envelopes the grains of sand, the fine solids are distributed in the water sheaths, and the bitumen is trappd in the interstitial spces between the water-sheathed grains.

The hot water process is now well described in the patent and technical literature.

In broad summary, this process comprises first conditioning the tar sand, to make it amenable to flotation separation of the bitumen from the solids. Conditioning involves feeding mined tar sand, hot water (180° F.), an alkaline process aid (usually NaOH), and steam into a rotating horizontal drum wherein the ingredients are agitated together. Typically, the amounts of reagents added are in the following proportions:

tar sand—3250 tons
hot water—610 tons
NaOH—4 tons (20% NaOH)

Enough steam is added to ensure an exit temperature of the mixture from the drum of about 180° F. The residence time in the drum is typically about 4 minutes.

During conditioning, the mined tar sand (in which the bitumen, connate water and solids are tightly bound together) becomes an aqueous slurry of porridge-like consistency, wherein the components are in loose association.

The slurry leaving the drum is screened, to remove oversize material, and then diluted with additional hot water. The product typically comprises 7% by weight bitumen, 43% water and 50% solids. Its temperature is typically 160°-180° F.

The diluted slurry then is transferred into a large separation vessel having a cylindrical upper section and conical lower section. Here the slurry is retained for about 45 minutes in a quiescent condition. Most of the sand sinks to the bottom and is discharged, together with some fines, water, and bitumen, through an outlet. This discharge is discarded as tailings.

The bitumen present in the separation vessel exists in the form of globules, some of which attach themselves to air bubbles entrained in the slurry during conditioning. The aerated bitumen tends to rise through the slurry and is recovered as a froth by a launder extending around the upper lip of the separation vessel. This froth is called primary froth. Typically, it comprises:

66.4%—bitumen
8.9%—solids
24.7%—water

Not all of the bitumen becomes sufficiently aerated to rise into the primary froth product. Much of this bitumen, together with much of the fines, tends to collect in the mid-section of the separation vessel. This aqueous mixture is termed "middlings".

The middlings are withdrawn from the vessel and are fed into subaerated flotation cells. Here the middlings are subjected to vigorous agitation and aeration. Bitumen froth, termed "secondary froth", is produced. Typically, this froth comprises:

23.8%—bitumen
17.5%—solids
58.7%—water

It will be noted that the secondary froth is considerably more contaminated with water and solids than the primary froth. One seeks to minimize this contamination, as the froth stream requires downstream treatment to remove solids and water, before it can be fed to the upgrading process.

It is desirable to operate the process so that as much of the bitumen as possible reports to the primary froth. The efficiency with which bitumen is collcted as primary froth is a measure of the success with which the entire bitumen in the tar sand feed has been brought to a condition amenable for spontaneous flotation. For this reason, we consider maximizing primary recovery as optimizing the entire process.

Now, the tar sand feed to the hot water process is not uniform in nature. Its properties vary in accordance with factors such as bitumen cotent, fines content, nature of the coarse solids, extent of ageing and weathering after mining, and the chemical nature of the bitumen. This variation in properties of the feedstock requires that the processing conditions be altered from time to time with a view to maximizing primary froth recovery. Some optimizing techniques, such as regulating middlings density within a preferred range or maintaining the temperature with a preferred narrow range, can assist in improving recovery over a narrow variation in the nature of the tar sand feed. But there is a need for identification of a parameter which can be monitored and used to maximize primary froth recovery over a wide range of different tar sand types.

At this point, it is useful to review the role of the "process aid", as it was understood in the past. The originator of the hot water process, Dr. Karl Clark, noted that the tar sand was acidic in nature. He taught the need to add an alkaline process aid, such as NaOH, to adjust the pH of the drum slurry to near neutral condition, in order to improve bitumen recovery in the primary separation step. Later investigators taught that it was desirable to maintain a slurry pH in the range of about 8-9, to maximize bitumen recovery.

More recently, Dr. Emerson Sandford, a co-worker of the present applicants, set forth in Canadian Pat. Nos. 1,100,074 and 1,094,003 that the role of the NaOH was to produce surfactants in the slurry by reaction with carboxylic and sulfonic acid substitutents present in the bitumen. He submitted that it was surfactants that were needed to condition the tar sand to free the bitumen from the other tar sand components and render said bitumen amenable to air attachment. He further taught that the level of fines would affect the surfactant requirements. In summary, he taught that:

(1) some process aid was needed for good primary recovery;

(2) the process aid functioned by generating surfactants within the slurry, which surfactants were required to maximize bitumen recovery; and (3) different tar sand types, having different fines contents, would require different quantities of NaOH in order to achieve maximum primary froth production.

However, up to this time there has been no single means identified in the prior art which would enable one to control the process aid addition to obtain maximum primary froth recovery while processing various types of tar sand ore, such as low grade (i.e. high fines) ore, marine ore, aged ore, and overburden-contaminated ore.

SUMMARY OF THE INVENTION

The present invention is based on the discovery that there is a critical level of free surfactant in solution in the aqueous phase of the drum slurry which always is requied to obtain maximum recovery of bitumen from the tar sand in the primary froth.

Having made this discovery, a process has been evolved comprising the following steps:

(1) first determining, for the extraction apparatus used, what the aforesaid critical level is for one tar sand type feedstock;

(2) then establishing from time to time the free surfactant content in the aqueous phase of the drum slurry as different tar sand type feedstocks are processed; and (3) varying the process aid addition to the slurry as the nature of the feedstock changes, to maintain said free surfactant level substantially at that value which results in maximum primary froth recovery.

The free surfactant content in the aqueous phase of the drum slurry may be established either by:

(a) measuring it directly; or (b) measuring the free surfactant content in another of the process streams associated with the hot water process (provided that such content is indicative of the free surfactant content in the aqueous phase of the drum slurry—this would, for example, be true of the middlings and tailings streams from the separation vessel).

DESCRIPTION OF THE PREFERRED EMBODIMENT

Figure 2:
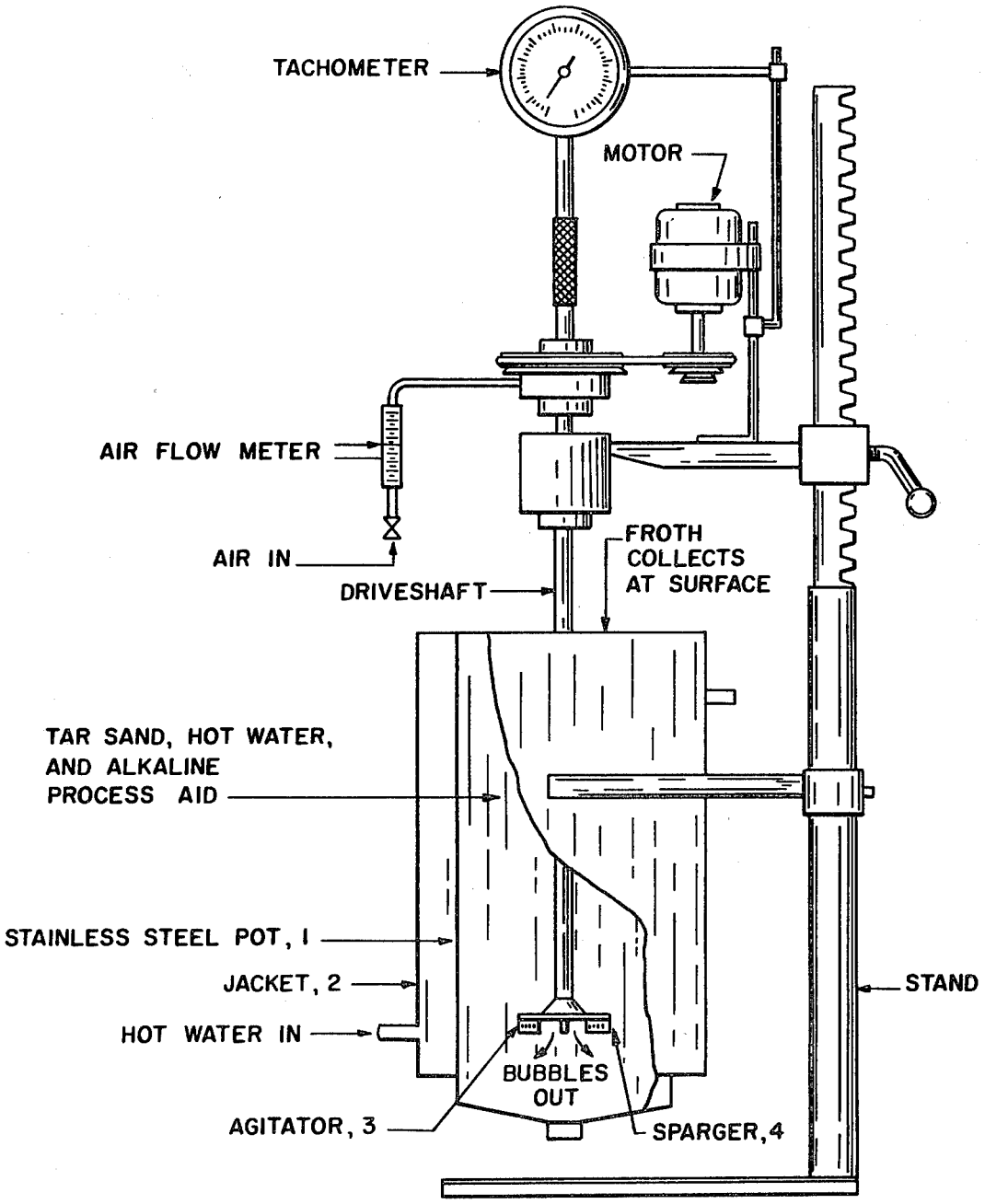
FIG. 2 is a side view of a laboratory apparatus used to develop the data underlying this invention—it has previously been established that there is a direct correlation of the results obtained using the apparatus of FIG. 2 with the results obtained using the circuit of FIG. 1.

The invention has been developed using the laboratory batch extraction unit shown in FIG. 2. The unit comprised a steel pot 1 surrounded by a heating jacket 2 supplied with temperature-controlled hot water. An agitator 3 and sparger 4 extended into the pot 1, as shown.

Figure 1:
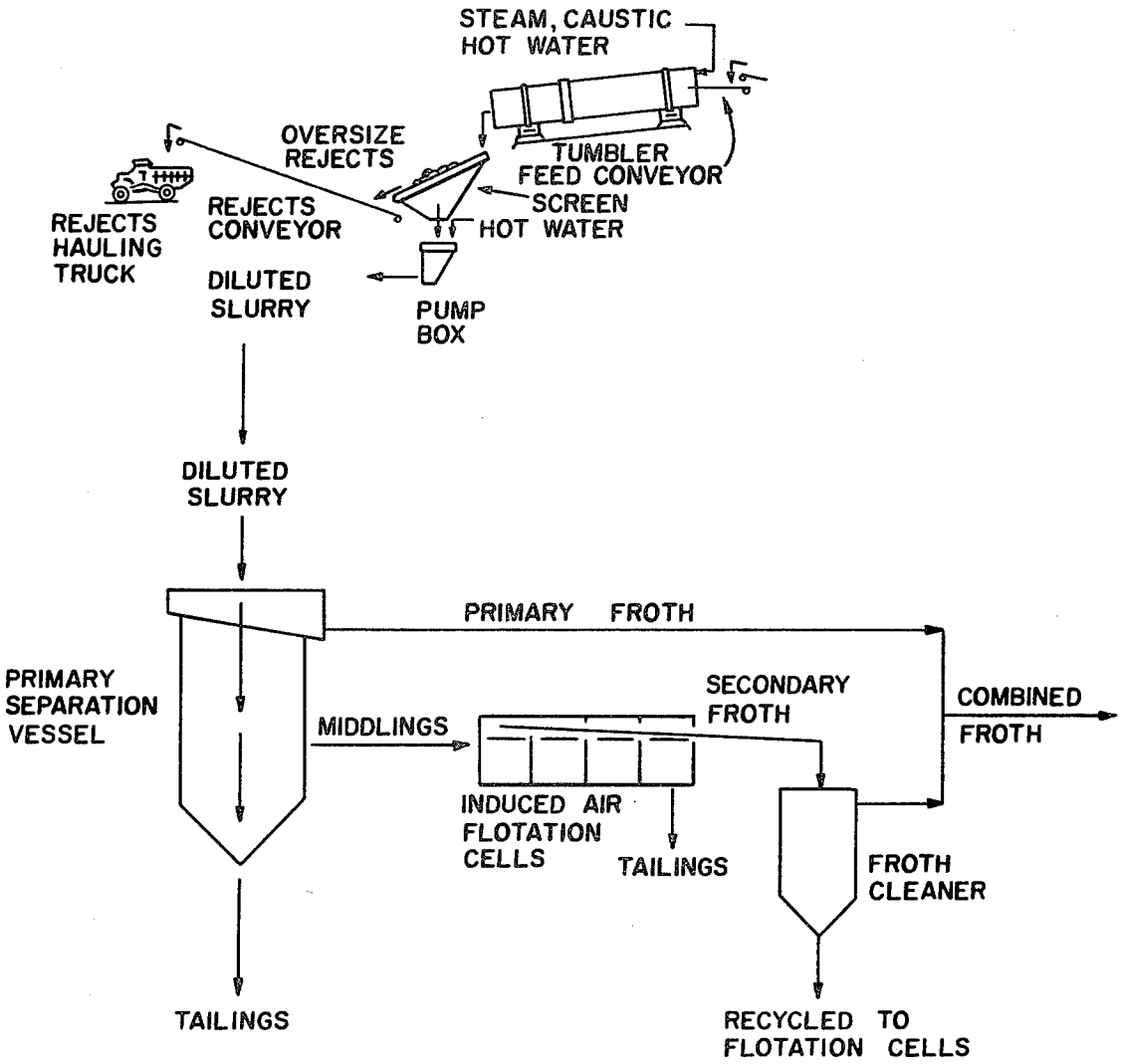
FIG. 1 is a schematic of a hot water process circuit of the type used commercially.

Previous experience with use of the laboratory unit had shown that its performance, when treating tar sand in acordance with the hot water process, correlates fairly closely with the performance of the commercial plant operated by the assignees and outlined in FIG. 1.

The work which produced the invention involved taking a single tar sand feedstock and subjecting portions of this feedstock to the hot water process in the FIG. 2 unit, keeping all conditions the same except for the amount of NaOH added. The free surfactant content in the secondary tailings from the unit was monitored in the manner described below. The results are plotted in FIG. 3.

More particularly, the common conditions used for all runs were as follows:

A charge of 500 g of tar sand, 150 ml of water (82° C.), and different amounts of NaOH, were introduced into the pot 1. Hot water was circulated through the jacket 2 to bring the charge to 82° C. and maintain it there. Once the charge was at temperature, it was agitated with the agitator 3 for 10 minutes at 600 rpm's while simultaneously introducing air into the charge at 7 ml per second through the sparger 4. The air was then switched off and the mixture flooded with 900 ml of hot water (82° C.). Mixing with the agitator 3 was continued for a further 10 minutes. The agitator was then switched off. The produced primary froth was skimmed off the surface of the mixture and weighed.

The residual mixture was then subjected to secondary separation. More particularly, it was agitated at 800 rpm for 5 minutes with air sparging at the rate of 4 ml/sec. The secondary froth produced was skimmed off.

The procedure as set forth above was practised on a single tar sand feedstock using various NaOH amaounts as set forth below. Table 1 gives the tar sand characteristics. Table 2 gives the extraction data for one of the tar sand types.

TABLE 1

| | | Tar Sand Properties | | | |
|---|---|---|---|---|---|
| Tar Sand | Comments | Oil Content % (w/w) | Water Content % (w/w) | Solids Content % (w/w) | Fines Content (< −44 μm) % (w/w solids) |
| Rich Marine | Fresh | 13.1 | 2.7 | 84.2 | 10.9 |
| | Fresh | 8.7 | 6.4 | 84.9 | 13.1 |
| | Aged 70 days | 8.7 | 6.4 | 84.9 | 13.1 |
| | Aged 90 days | 8.7 | 6.4 | 84.9 | 13.1 |

TABLE 2

| Extraction Data for the Marine Tar Sand Aged 70 Days | | | | | |
|---|---|---|---|---|---|
| NaOH Level (% w/w Tar Sand) | Mass Primary and Wall Froth (g) | Froth Composition (% w/w) | | | Percent Primary Recovery |
| | | Oil | Water | Solids | |
| 0.00 | 1.0 | 1.5 | 95.9 | 2.6 | 2.4 |
| 0.04 | 10.7 | 34.9 | 62.8 | 2.3 | 24.5 |
| 0.08 | 22.5 | 56.5 | 39.6 | 3.0 | 51.5 |

TABLE 2-continued

| NaOH Level (% w/w Tar Sand) | Extraction Data for the Marine Tar Sand Aged 70 Days: Mass Primary and Wall Froth (g) | Froth Composition (% w/w): Oil | Water | Solids | Percent Primary Recovery |
|---|---|---|---|---|---|
| 0.16 | 32.2 | 74.8 | 22.5 | 2.7 | 73.7 |
| 0.20 | 27.3 | 73.0 | 24.1 | 2.8 | 62.5 |
| 0.24 | 20.9 | 65.4 | 32.2 | 2.5 | 47.8 |

Calculation of Primary Recovery $$\text{Primary Recovery} = \frac{\text{wt. Bitumen in Primary Froth}}{\text{wt. total Bitumen in the Tar Sand}} \times 100$$

Surfactant Determination

Secondary tailings, as obtained above, were centrifuged at 15,000 G to remove suspended solids. An aliquot (50 mL) of the supernatent was then titrated with 0.05N hydrochloric acid. The titration was monitored by measuring pH and specific conductances. From such titrations, the concentration of total carboxylic acid salts (including surface active and non-surface active species) was obtained in the following manner.

Figure 4:
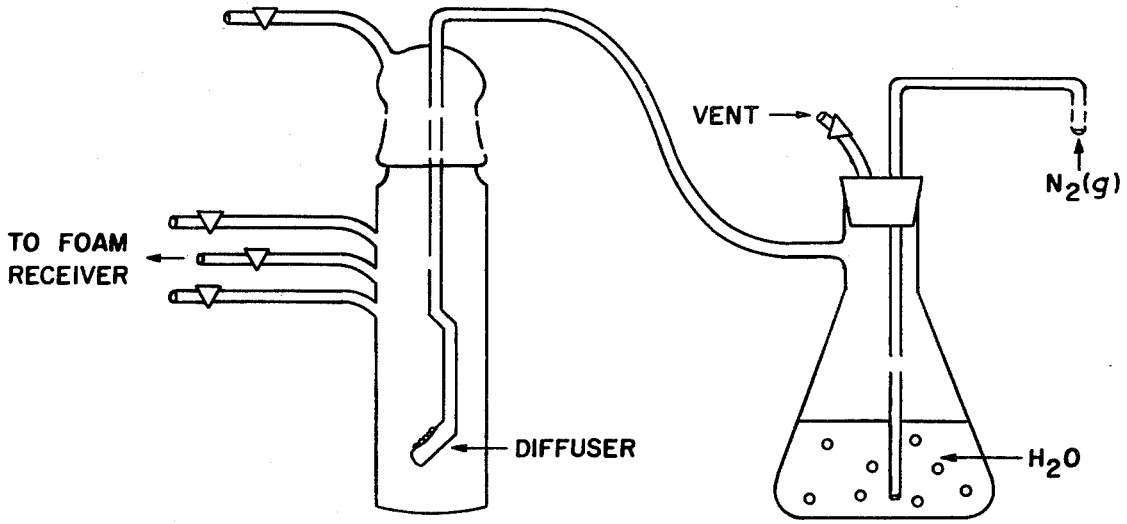
FIG. 4 is a side view of the foam fractionation column and nitrogen humidifier used to concentrate surface active compounds from centrifuged secondary tailings.

In order to determine the amount of surfactant in the secondary tailings samples, use was made of the tendency of surfactants to concentrate at interfaces. To this end, a second aliquot (200 mL) of the supernatent was foam fractionated in a 300 mL cylindrical vessel equipped with a nitrogen sparger, as shown in FIG. 4. We used a method similar to that of Bowman (see "Molecular and Interfacial Properties of Athabasca Tar Sands", Proc. 7th World Petroleum Congress, 3, 583-604, 1967). The nitrogen sparge was maintained at a (low) level which produced the smallest bubble sizes in the foam. Fractionation was continued until the surface tension of the residue reached a limiting value near that of pure water, as determined by a maximum bubble pressure technique. Aliquots (50 mL) of the fractionate and residue were each titrated to determine the total carboxylic salt content.

The surfactant concentration was determined as follows. The fractionate containing collapsed foam yields a salt concentration ($C^F$):

$$C^F = C_{ns}{}^F + C_s{}^F \quad (1)$$

where $C_{ns}{}^F$ and $C_s{}^F$ are the concentrations of non-surface active and surface active salts in the fractionate respectively. The residue contains only non-surface active salts hence $$C^R = C_{ns}{}^R \quad (2)$$

where the superscripts indicate the residue portion. At equilibrium the concentrations of non-surface active salts will be very nearly equal in the aqueous phases of the foam and in bulk solution:

$$C_{ns}{}^F = C_{ns}{}^R \quad (3)$$

Combining equations (1)-(3):

$$C^F = C^R + C_s{}^F \quad (4)$$

As $C^F$ and $C^R$ are determined by titration the surfaace active salts are obtained as $C_s{}^F$ from equation (4). With appropriate volume corrections the concentration of free surfactant present in the original (secondary tailings) sample was obtained.

An example of these calculations is now given for one extraction of the aged (70 day) marine tar sand.

Taking the 70 day aged marine ore processed at a sodium hydroxide addition level of 0.08 weight percent we have the following data Total secondary tailings sample volume = 1080 ml
Fractionate carboxylate salt content determination:
Total fractionated volume—202 ml = $V_{sample}$
Fractionate volume = 53 ml = $V_{fractionate}$
Aliquot volume = 52.5 ml = $V_{aliquot}$
Volume of acid titrated = 0.52 ml = $V_{HCl}$
Normality of acid = 0.0571N = $N_{HCL}$ $$\text{Therefore concentration of carboxylate salts} = \frac{N_{HCl} \cdot V_{HCl}}{V_{aliquot}} = 5.7 \times 10^{-4}\text{N} = C^F \text{ in equation (4).}$$

Residue carboxylate salt content determination:
Residue volume = 148 ml
Aliquot volume = 50.0 ml = $V_{aliquot}$
Volume of acid titrated = 0.37 ml = $V_{HCl}$
Normality of acid = 0.0571N = $N_{HCl}$ $$\text{Therefore concentration of carboxylate salts} = \frac{N_{HCl} \cdot V_{HCl}}{V_{aliquot}} = 4.3 \times 10^{-4}\text{N} = C^R \text{ in equation (4).}$$

From equation (4):

$$C_s{}^F = 1.4 \times 10^{-4}\text{N}$$

This is the concentration present in the fractionate sample $V_{fractionate}$. Therefore the carboxylate surfactant concentration in the total fractionated sample (and hence in the original tailings sample) is then $$C = \frac{C_s{}^F \cdot V_{fractionate}}{V_{sample}} = \frac{(1.4 \times 10^{-4}\text{N})\,(53\text{ mL})}{(202\text{ mL})} = 3.7 \times 10^{-5}\text{N}$$

The determination of free surfactant content has been described with respect to making the measurements on the aqueous phase of the secondary tailings. The same measurements may be made with the same benefit on other aqueous streams of the hot water process, such as the drum slurry, the primary separation vessel slurry, the primary tailings and the like, the only difference being the degree of dilution of the dissolved components.

When the phrase "aqeous phase of the slurry" is used in the claims hereunder, it is intended that the phrase will be interpreted to encompass these various hot water process aqueous streams.

Figure 3:
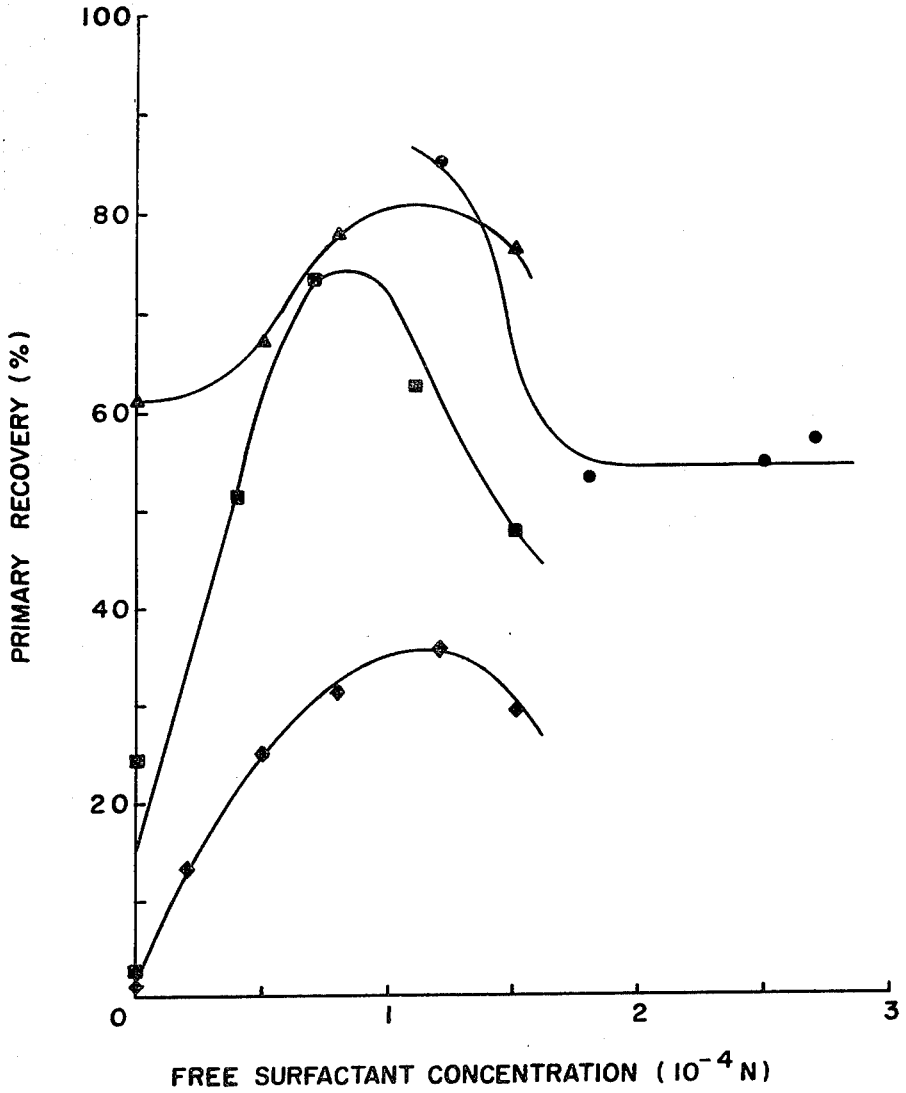
FIG. 3 is a plot for various tar sand type samples of primary bitumen froth recovery (%) against free surfactant concentration in secondary tailings from the circuit used.

The free surfactant content data have been plotted against primary recover to provide the curves shown in FIG. 3. It will be noted that there is a curve developd for each feedstock of Table 1, which has been treated with varying quantities of NaOH addition. The curve passes through a maximum. This maximum primary recovery occurs for only one value of free surfactant. Both below and above that value, the primary recovery diminishes. To summarize, for a given circuit, the maximum primary recovery for various tar sand feedstocks always occurs at substantially the same free surfactant concentration in the process water.

This finding makes it possible to operate a commercial circuit in accordance with the following steps:

(a) determine, for a single tar sand type and the extraction circuit used, the free surfactant, in the aqueous phase of the slurry, which will yield the maximum primary bitumen froth recovery;

(b) monitor the free surfactant content in the aqueous phase of the slurry during subsequent processing of various types of tar sand feed in said circuit; and (c) vary the process aid addition to the slurry as the nature of the tar sand feedstock varies, to maintain said free surfactant content substantially at the level which leads to maximum primary bitumen froth recovery as found for the tar sand in (a).

The embodiments of the invention in which an exclusive property of privilege is claimed are defined as follows:

1. In the process of extracting bitumen from tar sand of varying nature using the hot water process in an extraction circuit, wherein the tar sand is slurried in a conditioning drum with hot water and alkaline process aid, agitated, and then retained in a quiescent condition to produce primary bitumen froth, the improvement comprising:

determining, for a single tar sand type and the extraction circuit used, the optimum free surfactant content in the aqueous phase of the slurry, which will yield the maximum primary bitumen froth recovery;

monitoring the free surfactant content in the aqueous phase of the slurry during subsequent processing of various types of tar sand feed in said circuit;

and varying the process aid addition to the slurry as the nature of the tar sand feed varies, as required to maintain said free surfactant content substantially at the optimum free surfactant content previously established for the circuit.

2. The process as set forth in claim 1 wherein:

the optimum free surfactant content in the aqueous phase of the slurry is determined by operating the process with one tar sand feed type using different amounts of process aid addition to establish the amount which provides substantially maximum primary froth recovery.

* * * * *